United States Patent [19]

Schlüter et al.

[11] 4,098,289

[45] Jul. 4, 1978

[54] CHANGEOVER DEVICE FOR CONTROLLING THE MOVEMENT OF DOSING FRAMES

[75] Inventors: Hermann Schlüter; Manfred Blase, both of Essen, Germany

[73] Assignee: Didier Engineering GmbH, Essen, Germany

[21] Appl. No.: 782,787

[22] Filed: Mar. 30, 1977

[30] Foreign Application Priority Data

Apr. 28, 1976 [DE] Fed. Rep. of Germany ... 7613370[U]

[51] Int. Cl.[2] ..... C10B 27/06

[52] U.S. Cl. ..... 137/601; 202/139; 202/270

[58] Field of Search ..... 137/601; 202/139, 140, 202/141, 151, 239, 262, 270

[56] References Cited

U.S. PATENT DOCUMENTS 2,102,608 12/1937 Becker ..... 202/139 X

FOREIGN PATENT DOCUMENTS 974,914 5/1961 Fed. Rep. of Germany.

*Primary Examiner*—Robert G. Nilson

*Attorney, Agent, or Firm*—Wenderoth, Lind & Ponack

[57] ABSTRACT

A valve chamber which communicates through flue openings with bottom flues has therein a pair of dosing frames, each mounted on a pivot and movable thereby between a closed position against the openings and an open position withdrawn from the openings. Each pivot is attached to one end of an elongated eccentric member to the other end of which is attached a spring which urges the respective dosing frame to the closed or open position thereof. One or two pull rods are attached to the eccentrics to sequentially move the closed dosing frame away from the openings to the open position thereof, and to then move the open dosing frame to the openings to the closed position thereof.

26 Claims, 4 Drawing Figures

CHANGEOVER DEVICE FOR CONTROLLING THE MOVEMENT OF DOSING FRAMES

BACKGROUND OF THE INVENTION

The present invention relates to a changeover device for controlling dosing frames used in connection with a series of sole or bottom flues in a coke oven, particularly wherein two dosing frames in a valve chamber are each alternately folded between a dosing position in front of the bottom flue openings and a withdrawn position spaced from the bottom flue openings by means of timed angular rotation of pivots of the dosing frames.

Such dosing frames are described in German Pat. No. 974,914. The dosing frames are provided with dosing openings associated with the separate bottom flues and the free cross-section of such dosing openings is adjustable. The dosing openings of the two frames are of different sizes, dependent on the requirements of the particular operation. In regeneratively heated combination or vertical-flue regenerative ovens, one of the two dosing frames is associated with each direction of flow.

SUMMARY OF THE INVENTION

The object of the present invention is to provide a changeover device for such dosing frames, and particularly a changeover device which makes it possible to reliably operate the dosing frames with a low expenditure of force and which ensures tight contact between the dosing frames and the bottom flue openings.

This object is achieved according to the present invention by providing that each dosing frame is mounted on a pivot to which is fixed an eccentric which presses the dosing frame against the bottom flue openings by the action of a spring, and that a pull rod engaging the eccentrics is provided for changing the positions of the dosing frames. The springs resiliently urge the dosing frames against the bottom flue openings to ensure tight contact therebetween, even in the case of assembly tolerances. A reliable operation at low expenditure of force is achieved in that upon operation of the pull rod or pusher the spring causes the dosing frame to snap against the bottom flue openings.

Ready accessibility and easy inspection of the control elements are provided in that the eccentrics are preferably positioned outside the valve chamber.

Each eccentric is preferably held by the respective spring both in the open or withdrawn position and also in the closed position of the respective dosing frame. In moving from one position to the other, after a dead center position is reached, the spring assists further movement of the respective eccentric.

If a plurality of juxtaposed valve chambers are to be simultaneously operated, it is of advantage to shift or incline the eccentrics by about 45° in relation to the planes or surfaces of the respective dosing frames. A plurality of eccentrics may be coupled together in this manner.

According to a further feature of the invention, two pull rods are provided, one each connected to pairs of eccentrics of the dosing frames of two juxtaposed valve chambers. On operation of a first of the pull rods, the dosing frames positioned against the bottom flue openings are folded away therefrom. Thereafter, operation of the second pull rod causes the dosing frames which had been folded away from the bottom flue openings to be moved into positions thereagainst.

According to a still further feature of the invention, the eccentrics associated with the dosing frames of two or more valve chambers can be operated by a single pull rod or pusher, which is provided with separate driving elements for each of the eccentrics. The driving elements associated with the open dosing frames are staggered in relation to those associated with the closed dosing frames. Thus, upon movement of the pusher the closed dosing frames, i.e. those frames positioned in front of the bottom flue openings, are first folded away from the flue openings, and then the other, previously withdrawn dosing frames are folded into positions in front of the bottom flue openings. By properly positioning the driving elements and/or the eccentrics, the dosing frames of a given valve chamber do not contact each other, even though their paths of movement intersect.

BRIEF DESCRIPTION OF THE DRAWINGS

Further objects and features of the present invention will be apparent from the following description taken with the accompanying drawings, wherein.

DETAILED DESCRIPTION OF THE INVENTION

Figure 1:
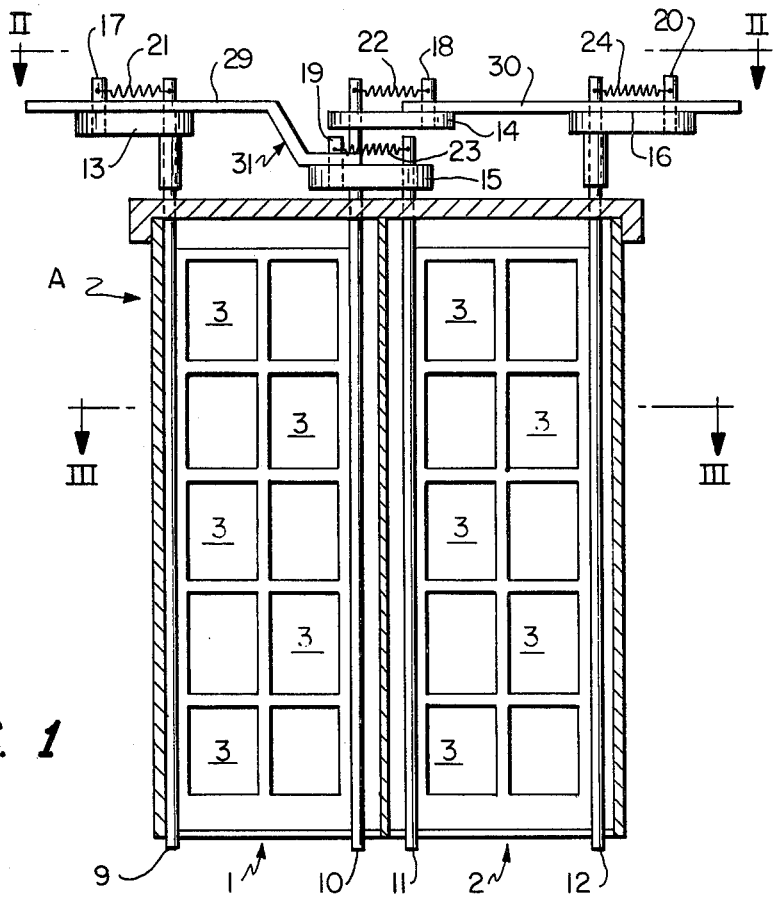
FIG. 1 is a section through two juxtaposed valve chambers of a blow through or exhaust gas valve of a coke oven chamber taken along each of lines I—I in FIGS. 2 and 3, but with the dosing frames not being shown and all of the dosing frame pivot rods shown in positions whereat the dosing frames thereof would be folded away from the openings of the sole or bottom flues.

The exhaust gas or blow through valve A includes therein two valve chambers 1 and 2. Each valve chamber 1 and 2 communicates through openings 8 with the ends of ten separate sole or bottom flues 3 of a coke oven. In order to regulate the effective cross-section of the openings of separate bottom flues 3, i.e. to dose the flow of gas passing through, two dosing frames 4, 5 and 6, 7 are arranged in each of valve chambers 1 and 2, respectively. In the position shown in FIGS. 2 and 3, dosing frames 5 and 7 are situated tightly in front of openings 8 of bottom flues 3. It is to be understood that the present invention is not limited to an arrangement wherein 10 bottom flues communicate with each valve chamber. The concept of the present invention is equally applicable when a lesser or greater number of bottom flues communicate with a blow through valve chamber.

Dosing frames 4–7 may include plates which are mounted in an adjustably displaceable manner, or alternatively plates such as sheet metal plates of different sizes can be inserted in or attached to the dosing frames. Since such plates do not in and of themselves form any part of the present invention, they are not shown in the drawings to facilitate clarity of illustration. Rather, dosing frames 4–7 are merely shown schematically in FIG. 3. The position of displacement of such plates will however determine the effective cross-section of bottom flues 3. It will be apparent that the plates of dosing frames 4 and 6 have settings differing from those of dosing frames 5 and 7, to thereby achieve differing effective cross-sections of flues 3.

Dosing frames 4 and 6 are attached to pivots 9 and 11, respectively, situated on the left-hand sides of the respective valve chambers 1 and 2, as viewed in FIG. 1. Dosing frames 5 and 7 are attached to pivots 10 and 12, respectively, situated on the right-hand sides of the respective valve chambers 1 and 2, as viewed in FIG. 1. Pivots 9–12 project upwardly from respective valve chambers 1 and 2. The upper or outwardly projecting ends of pivots 9–12 have fixed thereto eccentrics 13–16, respectively. Eccentrics 13–16 are elongated members, each of which is connected at one end thereof with the respective pivot 9–12 and which extends from such respective pivot in a direction inclined at an angle, preferably 45°, to the plane of the respective dosing frame 4–7. Preferably, all of the elongated eccentrics extend in parallel directions, as shown in FIG. 2, when the dosing frames are positioned such that some of the dosing frames are in front of flue openings 8.

Eccentrics 13–16 have at second ends thereof pins 17–20, respectively. Each pin 17–20 is engaged by one end of a tension spring 21–24, respectively. The other ends of tension springs 21–24 are attached to pegs or pins 25–28, respectively, arranged behind pivots 9–12. Specifically, pegs 25–28 are respectively aligned with pivots 9–12 in a direction substantially longitudinally of the direction of bottom flues 3, or in a direction extending substantially parallel with those dosing frames which are spaced from the bottom flues, i.e. dosing frames 4 and 6 in FIG. 3, or in a direction substantially perpendicular to those dosing frames which are positioned in front of flue openings 8, i.e. dosing frames 5 and 7 in FIG. 3.

Due to the above described arrangement of tension springs 21–24, dosing frames 4–7 are urged by respective springs 21–24 in their end positions of movement. Particularly with the elements in the positions shown in FIGS. 2 and 3 of the drawings, springs 21 and 23 extend in a direction at an angle to respective eccentrics 13 and 15, and thereby the tension of springs 21 and 23 causes dosing frames 4 and 6 to be pivoted about pivots 9 and 11, respectively, into the respective end positions away from flue openings 8 as shown in FIG. 3. Similarly, tension springs 22 and 24 extend in directions at angles to eccentrics 14 and 16 and thus cause dosing frames 5 and 7 to be pivoted about respective pivots 10 and 12 into the end positions against flue openings 8 as shown in FIG. 3. Specifically, the tension of springs 22 and 24 strongly urges dosing frames 5 and 7 tightly against flue openings 8.

Figure 2:
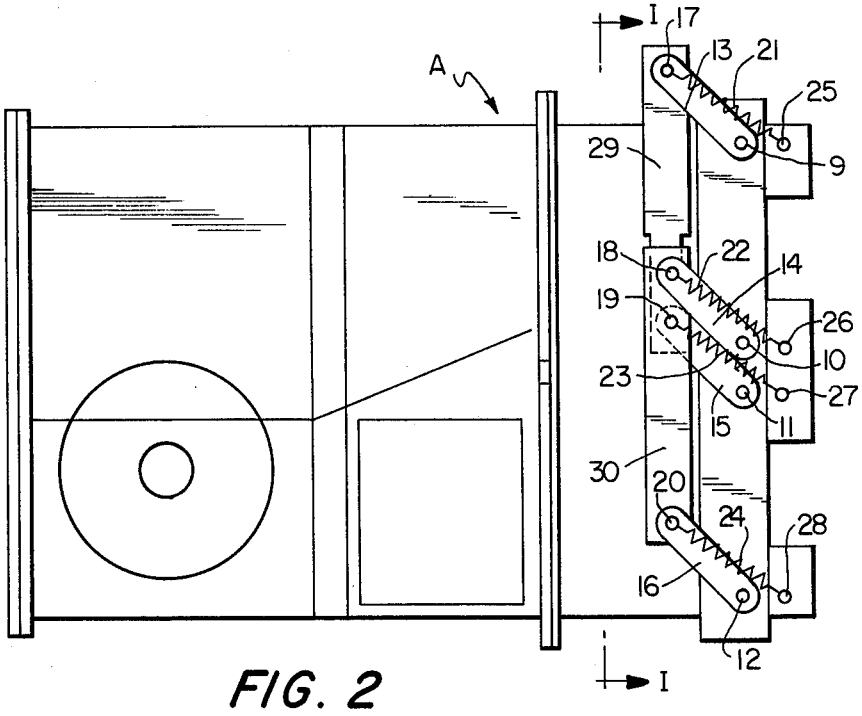
FIG. 2 is a plan view of the blow through valve of FIG. 1 taken along line II—II of FIG. 1, but wherein in each of the chambers one of the respective dosing frames is folded to a position in front of the openings of the respective bottom flues.
Figure 3:
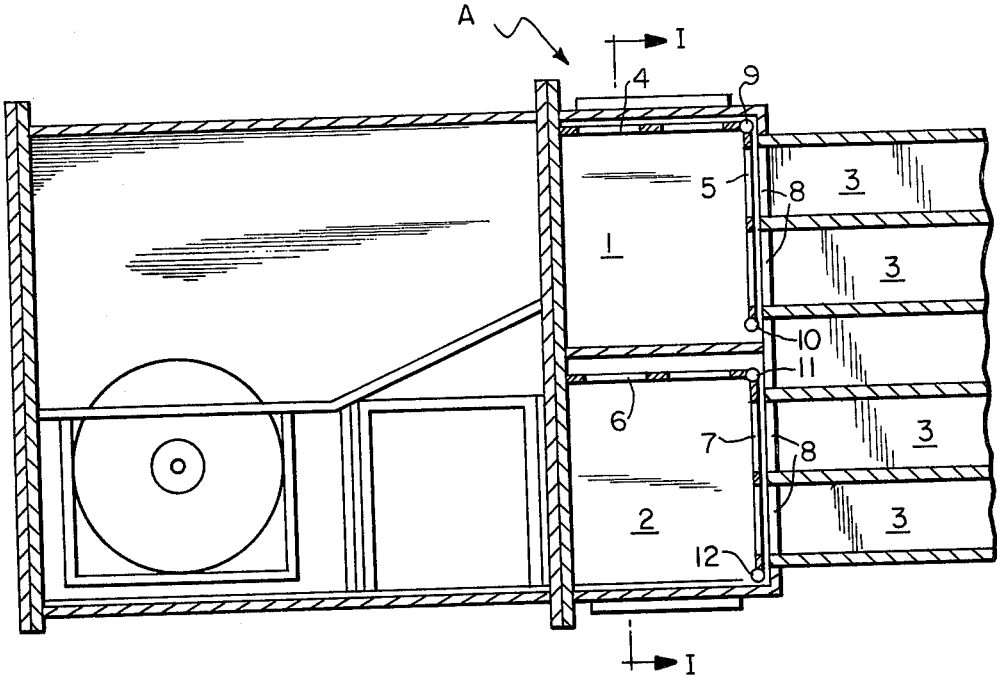
FIG. 3 is a section taken along line III—III of FIG. 1, with the dosing frames being positioned as in FIG. 2.

Furthermore, when eccentrics 14 and 16 are moved in a counter-clockwise direction with respect to FIG. 2 so that dosing frames 5 and 7 are moved away from flue openings 8, during the first portion of such movement the moving force will be counteracted by the tension of springs 22 and 24. However, when eccentrics 14 and 16 are moved by a distance such that the respective dead center positions are reached, i.e. at a position wherein springs 22 and 24 pass over pivots 10 and 12, further movement of eccentrics 14 and 16 will be aided by the tension force of springs 22 and 24, and springs 22 and 24 will act to strongly move dosing frames 5 and 7 into their respective positions spaced from flue openings 8.

Similarly of course, when thereafter eccentrics 13 and 15 are pivoted in a counter-clockwise direction with respect to FIG. 2 to move dosing frames 4 and 6 from the withdrawn position shown in FIG. 3 to positions against flue openings 8, a first portion of such movement will be against the force of springs 21 and 23. However, when eccentrics 13 and 15 are moved to dead center positions, i.e. wherein springs 21 and 23 are above respective pivots 9 and 11, further movement of eccentrics 13 and 15 and thus of dosing frames 4 and 6 will be assisted or aided by springs 21 and 23. Thus, the tension force of springs 21 and 23 will thereby tightly urge dosing frames 4 and 6 against flue openings 8.

In the embodiment of FIG. 2, a first pull rod 29 is coupled to pins 17 and 19, and thereby via eccentrics 13 and 15 to dosing frames 4 and 6. A second pull rod 30 is coupled to pins 18 and 20, and thereby via eccentrics 14 and 16 to dosing frames 5 and 7.

In order to prevent juxtaposed eccentrics 14 and 15, during respective separate pivoting movements thereof, from interfering with each other, eccentrics 14 and 15 are positioned in separate spaced planes. For example, as shown in FIG. 1, eccentric 14 may be situated above the plane of motion of eccentric 15, and pull rod 29 accordingly possesses a double-bend section 31.

The operation of the system of FIGS. 1–3 will now be described.

If the system is initially as shown in FIGS. 2 and 3, and if the positions of dosing frames 4–7 are to be changed, such that dosing frames 4 and 6 are in front of flue openings 8 and dosing frames 5 and 7 are withdrawn therefrom, pull rod 30 is first moved in a direction downwardly with respect to FIG. 2. During this movement, dosing frames 5 and 7 are simultaneously folded away from openings 8 of bottom flues 3. As soon as pull rod 30, pins 18 and 20, springs 22 and 24, and eccentrics 14 and 16 reach the positions thereof shown in FIG. 1, pull rod 29 is then displaced downwardly with respect to FIG. 2, so that dosing frames 4 and 6 are then folded to positions in front of openings 8 of sole flues 3. The force of springs 21 and 23 will cause dosing frames 4 and 6 to be tightly urged against openings 8.

Figure 4:
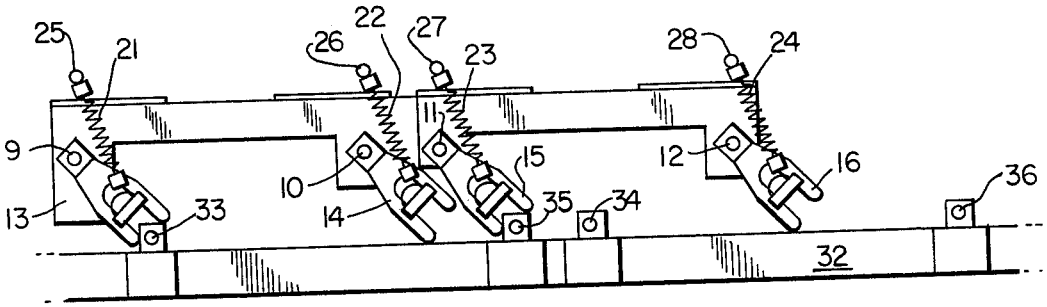
FIG. 4 is a plan view of a modified embodiment of a single pull rod for controlling all the dosing frames.

FIG. 4 shows a further feature of the present invention, wherein all of the eccentrics 13–16 are operated by a single pull rod 32. Driving pins 33–36 are adjustably attached to pull rod 32. Driving pins 33–36 are associated respectively with eccentrics 13–16. In order to prevent respective obstruction between eccentrics 14 and 15 as well as driving pins 34 and 35, eccentric 14 and driving pin 34 are positioned in a plane spaced from that of eccentric 15 and driving pin 35. Specifically, eccentric 15 and driving pin 35 are situated in a plane lower than that of eccentric 14 and driving pin 34.

The operation of the embodiment of FIG. 4 will now be described.

If the system is initially as shown in FIG. 4, and if the positions of the dosing frames are to be changed, then pull rod 32 is shifted to the left with respect to FIG. 4. During this movement, driving pins 33 and 35 first simultaneously pivot eccentrics 13 and 15 in a clockwise direction with respect to FIG. 4. Accordingly, the dosing frames associated therewith, e.g. dosing frames 4 and 6, are moved away from flue openings 8, against which they had been positioned. During further movement of pull rod 32 in the left direction of FIG. 4, driving pins 34 and 36 engage and pivot in a clockwise direction eccentrics 14 and 16, thereby moving the dosing frames associated therewith, e.g. dosing frames 5 and 7, into tight contact with the flue openings.

In the embodiment of FIG. 4, the relative positioning of driving pins 33–36 is such that, for example with reference to the moving operation described above, driving pins 34 and 36 can begin pivoting of eccentrics 14 and 16 and thereby dosing frames 5 and 7 as soon as driving pins 33 and 35 have moved eccentrics 13 and 15 and thereby dosing frames 4 and 6 by a sufficient distance such that the movement of frames 4 and 6 will not interfere with the movement of frames 5 and 7, and vice versa. That is, frames 4 and 6 need not be moved to the completely withdrawn positions before movement of frames 5 and 7 commences.

It will be apparent that various modifications may be made to the above specifically described arrangements without departing from the scope of the invention. For example, a single pull rod could operate a plurality of blow through valves A. Also, the blow through valve could include more than two valve chambers.

What is claimed is:

1. A changeover device for controlling the movement of a pair of dosing frames in a valve chamber, wherein each dosing frame is mounted on a pivot which is rotatable to move the respective dosing frame between a closed position in front of openings of flues communicating with the valve chamber and an open position withdrawn from such openings, said dosing frames being alternately movable between said respective closed and open positions thereof, said changeover device comprising:

a plurality of eccentrics, one each adapted to be attached to a respective said pivot;

means, attached to each of said eccentrics, for selectively pivoting said eccentrics, and for thereby moving the respective dosing frames between said open and closed positions thereof; and a plurality of spring means, one each attached to a respective said eccentric, for urging said respective dosing frames into the respective closed or open position thereof dependent on the position of said moving means.

2. A device as claimed in claim 1, wherein said eccentrics are adapted to be attached to said pivots at positions thereof exterior of said valve chamber.

3. A device as claimed in claim 1, wherein each said eccentric comprises an elongated member adapted to be attached at a first end thereof to the respective said pivot and attached at a second end thereof to the respective said spring means.

4. A device as claimed in claim 3, wherein each said spring means comprises a tension spring having a first end attached to the said second end of the respective said eccentric and a second end attached to a fixed peg spaced from the respective pivot in a direction perpendicular to the plane of the flue openings.

5. A device as claimed in claim 4, wherein each said elongated member extends in a direction inclined at an angle to the plane of the respective said dosing frame.

6. A device as claimed in claim 5, wherein said angle is approximately 45°.

7. A device as claimed in claim 1, wherein there are provided a plurality of juxtaposed valve chambers, each having therein a pair of dosing frames each attached to a respective pivot, and wherein said moving means comprises a first pull rod attached to said eccentrics of a first of the dosing frames in each said valve chamber, and a second pull rod attached to said eccentrics of a second of the dosing frames in each said valve chamber.

8. A device as claimed in claim 7, wherein adjacent of said eccentrics in separate of said valve chambers are positioned for pivoting movement in separate spaced planes.

9. A device as claimed in claim 7, wherein said pivots of said first dosing frames are each positioned on a first side of the respective said valve chamber, and said pivots of said second dosing frames are each positioned on a second side of the respective said valve chamber.

10. A device as claimed in claim 1, wherein there are provided a plurality of juxtaposed valve chambers, each having therein a pair of dosing frames each attached to a respective pivot, and wherein said moving means comprises a single pull rod having mounted thereon a plurality of driving elements, one each positioned to engage and pivot a respective one of said eccentrics upon movement of said pull rod in a single direction.

11. A device as claimed in claim 10, wherein said driving elements comprise a first plurality of driving elements positioned to engage eccentrics of a first of the dosing frames in said valve chambers, and a second plurality of driving elements positioned to engage said eccentrics of a second of the dosing frames in said valve chambers, said first and second driving elements being positioned on said single pull rod such that said second driving elements do not pivot the eccentrics of said second dosing frames until said first driving elements have pivoted said eccentrics of said first dosing frames to positions such that said first dosing frames will not interfere with movement of said second dosing frames.

12. A device as claimed in claim 10, wherein adjacent of said eccentrics in separate of said valve chambers are positioned for pivoting movement in separate spaced planes.

13. A device as claimed in claim 10, wherein said pivots of said first dosing frames are each positioned on a first side of the respective said valve chamber, and said pivots of said second dosing frames are each positioned on a second side of the respective said valve chamber.

14. In a system including at least one valve chamber communicating through flue openings with flues, said at least one valve chamber having therein a pair of dosing frames each attached to a pivot, said pair of pivots being pivotable to alternately move the respective said dosing frames between a respective closed position in front of said flue openings and a respective open position withdrawn from said flue openings, and a changeover device for controlling the movement of said pair of dosing frames between said respective closed and open positions thereof, the improvement wherein said changeover device comprises:

a plurality of eccentrics, one each attached to a respective said pivot;

means, attached to each of said eccentrics, for selectively pivoting said eccentrics, and for thereby moving the respective dosing frames between said open and closed positions thereof; and a plurality of spring means, one each attached to a respective said eccentric, for urging said respective dosing frames into the respective closed or open position thereof dependent on the position of said moving means.

15. The improvement claimed in claim 14, wherein said eccentrics are attached to said pivots at positions thereof exterior of said valve chamber.

16. The improvement claimed in claim 14, wherein each said eccentric comprises an elongated member attached at a first end thereof to the respective said pivot and attached at a second end thereof to the respective said spring means.

17. The improvement claimed in claim 16, wherein each said spring means comprises a tension spring having a first end attached to the said second end of the respective said eccentric and a second end attached to a fixed peg spaced from the respective pivot in a direction perpendicular to the plane of the flue openings.

18. The improvement claimed in claim 17, wherein each said elongated member extends in a direction inclined at an angle to the plane of the respective said dosing frame.

19. The improvement claimed in claim 18, wherein said angle is approximately 45° .

20. The improvement claimed in claim 14, wherein said at least one valve chamber comprises a plurality of juxtaposed valve chambers, each having therein a pair of dosing frames each attached to a respective pivot, and wherein said moving means comprises a first pull rod attached to said eccentrics of a first of the dosing frames in each said valve chamber, and a second pull rod attached to said eccentrics of a second of the dosing frames in each said valve chamber.

21. The improvement claimed in claim 20, wherein adjacent of said eccentrics in separate of said valve chambers are positioned for pivoting movement in separate spaced planes.

22. The improvement claimed in claim 20, wherein said pivots of said first dosing frames are each positioned on a first side of the respective said valve chamber, and said pivots of said second dosing frames are each positioned on a second side of the respective said valve chamber.

23. The improvement claimed in claim 14, wherein said at least one valve chamber comprises a plurality of juxtaposed valve chambers, each having therein a pair of dosing frames each attached to a respective pivot, and wherein said moving means comprises a single pull rod having mounted thereon a plurality of driving elements, one each positioned to engage and pivot a respective one of said eccentrics upon movement of said pull rod in a single direction.

24. The improvement claimed in claim 23, wherein said driving elements comprise a first plurality of driving elements positioned to engage said eccentrics of a first of the dosing frames in said valve chambers, and a second plurality of driving elements positioned to engage said eccentrics of a second of the dosing frames in said valve chambers, said first and second driving elements being positioned on said single pull rod such that said second driving elements do not pivot the eccentrics of said second dosing frames until said first driving elements have pivoted said eccentrics of said first dosing frames to positions such that said first dosing frames will not interfere with movement of said second dosing frames.

25. The improvement claimed in claim 23, wherein adjacent of said eccentrics in separate of said valve chambers are positioned for pivoting movement in separate spaced planes.

26. The improvement claimed in claim 23, wherein said pivots of said first dosing frames are each positioned on a first side of the respective said valve chamber, and said pivots of said second dosing frames are each positioned on a second side of the respective said valve chamber.

* * * * *